US011066731B2

(12) United States Patent
Tanihara et al.

(10) Patent No.: US 11,066,731 B2
(45) Date of Patent: Jul. 20, 2021

(54) ELECTRIC CONTACT AND VACUUM INTERRUPTER USING SAME

(71) Applicant: Mitsubishi Electric Corporation, Tokyo (JP)

(72) Inventors: Yasutomo Tanihara, Tokyo (JP); Hiroyuki Chibahara, Tokyo (JP); Taiki Donen, Tokyo (JP); Satoshi Ochi, Tokyo (JP); Takayuki Itotani, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/759,926

(22) PCT Filed: Jul. 13, 2018

(86) PCT No.: PCT/JP2018/026547

§ 371 (c)(1),
(2) Date: Apr. 28, 2020

(87) PCT Pub. No.: WO2019/155655

PCT Pub. Date: Aug. 15, 2019

(65) Prior Publication Data

US 2020/0277688 A1 Sep. 3, 2020

(30) Foreign Application Priority Data

Feb. 6, 2018 (JP) ..... JP2018-019241

(51) Int. Cl.
*H01H 33/662* (2006.01)
*H01H 33/664* (2006.01)
*C22C 29/08* (2006.01)

(52) U.S. Cl.
CPC ..... *C22C 29/08* (2013.01); *H01H 33/662* (2013.01); *H01H 33/664* (2013.01)

(58) Field of Classification Search
CPC ... C22C 1/1084; C22C 1/0491; C22C 1/0425; C22C 1/05; C22C 9/00; B22F 2999/00;
(Continued)

(56) References Cited

U.S. PATENT DOCUMENTS 4,547,639 A * 10/1985 Watanabe ..... H01H 1/0203 200/279
5,130,068 A * 7/1992 Naya ..... H01H 1/0203 419/8

(Continued)

FOREIGN PATENT DOCUMENTS

JP 2007332429 A 12/2007
JP 2014056784 A 3/2014

OTHER PUBLICATIONS

International Search Report (PCT/ISA/210) dated Sep. 18, 2018, by the Japan Patent Office as the International Searching Authority for International Application No. PCT/JP2018/026547.

(Continued)

*Primary Examiner* — William A Bolton
(74) *Attorney, Agent, or Firm* — Buchanan Ingersoll & Rooney PC

(57) ABSTRACT

In an electric contact including a base material, high-melting-point substance particles, and an intermetallic compound, the intermetallic compound containing a MnX compound (X represents Te or Se) and a compound of a Mn—Cu solid-solution phase and X, is dispersed in the base material. If the Vickers hardness of the high-melting-point substance particles is higher than 0 Hv and lower than 200 Hv, the particle diameter of the high-melting-point substance particles is not smaller than 0.1 μm and not larger than 100 μm. If the Vickers hardness of the high-melting-point substance particles is 200 Hv or higher, the particle diameter is not smaller than 0.1 μm and not larger than 10 μm. The mass of X atoms is not lower than 1.5 mass % and not higher than (Continued)

15 mass %. The atomic weight ratio Mn/(Mn+X) is not lower than 20 at % and not higher than 80 at %.

7 Claims, 11 Drawing Sheets

(58) Field of Classification Search
CPC ..... B22F 2998/10; B22F 1/00; B22F 3/02; B22F 3/10
USPC ..... 218/139, 123, 130, 132, 146; 200/265
See application file for complete search history.

(56) References Cited

U.S. PATENT DOCUMENTS

| | | | | |
|---|---|---|---|---|
| 5,697,150 | A * | 12/1997 | Komuro | C22C 1/045 164/94 |
| 6,024,896 | A * | 2/2000 | Okutomi | C22C 29/08 252/504 |
| 7,704,449 | B2 * | 4/2010 | Kikuchi | H01H 33/6643 419/38 |
| 2004/0079191 | A1 * | 4/2004 | Kobayashi | C22C 29/02 75/242 |
| 2014/0076852 | A1 | 3/2014 | Kikuchi et al. | |

OTHER PUBLICATIONS

Written Opinion (PCT/ISA/237) dated Sep. 18, 2018, by the Japan Patent Office as the International Searching Authority for International Application No. PCT/JP2018/026547.

* cited by examiner

FIG. 2

TABLE 1

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 1 | 38.9 | 55.1 | 6.3 | 0.0 | 6.0 | 0.0 | 0.0 | ABSENT | 124 | – | – | CRACK AT TIME OF PROCESSING |
| COMPARATIVE EXAMPLE 2 | 38.5 | 55.1 | 6.3 | 0.4 | 6.0 | 13.4 | 0.4 | PRESENT | 156 | – | – | CRACK AT TIME OF PROCESSING |
| EXAMPLE 1 | 38.1 | 55.1 | 6.3 | 0.8 | 6.0 | 23.6 | 1.0 | PRESENT | 269 | 0.36 | PASSED | |
| EXAMPLE 2 | 35.9 | 55.1 | 6.3 | 3.0 | 6.0 | 53.7 | 2.4 | PRESENT | 358 | 0.42 | PASSED | |
| EXAMPLE 3 | 32.9 | 55.1 | 6.3 | 6.0 | 6.0 | 69.9 | 5.0 | PRESENT | 371 | 0.28 | PASSED | |
| EXAMPLE 4 | 29.9 | 55.1 | 6.3 | 9.0 | 6.0 | 77.7 | 9.7 | PRESENT | 362 | 0.33 | PASSED | |
| COMPARATIVE EXAMPLE 3 | 26.9 | 55.1 | 6.3 | 12.0 | 6.0 | 82.3 | 10.8 | PRESENT | 377 | 0.21 | FAILED | |

FIG. 3

TABLE 2

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 4 | 43.4 | 55.1 | 6.3 | 0.5 | 1.0 | 53.7 | 1.6 | PRESENT | 381 | 1.52 | PASSED | |
| EXAMPLE 5 | 42.7 | 55.1 | 6.3 | 0.8 | 1.5 | 53.7 | 2.4 | PRESENT | 360 | 0.95 | PASSED | |
| EXAMPLE 6 | 31.4 | 55.1 | 6.3 | 4.5 | 9.0 | 53.7 | 3.8 | PRESENT | 351 | 0.35 | PASSED | |
| EXAMPLE 7 | 26.9 | 55.1 | 6.3 | 6.0 | 12.0 | 53.7 | 4.8 | PRESENT | 334 | 0.22 | PASSED | |
| EXAMPLE 8 | 22.4 | 55.1 | 6.3 | 7.5 | 15.0 | 53.7 | 5.3 | PRESENT | 312 | 0.15 | PASSED | |
| COMPARATIVE EXAMPLE 5 | 19.9 | 55.1 | 6.3 | 8.0 | 17.0 | 53.7 | 6.7 | PRESENT | 298 | 0.13 | FAILED | |

FIG. 4

TABLE 3

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 6 | 76.0 | 15.0 | 6.3 | 3.0 | 6.0 | 53.7 | 2.6 | PRESENT | 322 | 1.30 | FAILED | |
| EXAMPLE 9 | 71.0 | 20.0 | 6.3 | 3.0 | 6.0 | 53.7 | 2.8 | PRESENT | 330 | 0.80 | PASSED | |
| EXAMPLE 10 | 51.0 | 40.0 | 6.3 | 3.0 | 6.0 | 53.7 | 2.7 | PRESENT | 331 | 0.62 | PASSED | |
| EXAMPLE 11 | 21.0 | 70.0 | 6.3 | 3.0 | 6.0 | 53.7 | 3.0 | PRESENT | 356 | 0.38 | PASSED | |
| EXAMPLE 12 | 11.0 | 80.0 | 6.3 | 3.0 | 6.0 | 53.7 | 2.3 | PRESENT | 380 | 0.34 | PASSED | |
| COMPARATIVE EXAMPLE 7 | 6.0 | 85.0 | 6.3 | 3.0 | 6.0 | 53.7 | – | – | – | – | – | UNABLE TO BE MOLDED |

FIG. 5

TABLE 4

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 8 | 35.9 | 55.1 | 25.00 | 3.0 | 6.0 | 53.7 | 3.2 | PRESENT | 103 | – | – | CRACK AT TIME OF PROCESSING |
| COMPARATIVE EXAMPLE 9 | 35.9 | 55.1 | 12.00 | 3.0 | 6.0 | 53.7 | 3.5 | PRESENT | 258 | 0.52 | FAILED | |
| EXAMPLE 13 | 35.9 | 55.1 | 9.00 | 3.0 | 6.0 | 53.7 | 3.2 | PRESENT | 330 | 0.45 | PASSED | |
| EXAMPLE 14 | 35.9 | 55.1 | 3.00 | 3.0 | 6.0 | 53.7 | 3.4 | PRESENT | 356 | 0.43 | PASSED | |
| EXAMPLE 15 | 35.9 | 55.1 | 1.00 | 3.0 | 6.0 | 53.7 | 3.2 | PRESENT | 380 | 0.37 | PASSED | |
| COMPARATIVE EXAMPLE 10 | 35.9 | 55.1 | 0.08 | 3.0 | 6.0 | 53.7 | – | – | – | – | – | UNABLE TO BE MOLDED |

FIG. 6

TABLE 5

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| EXAMPLE 16 | 35.9 | 55.1 | 6.3 | 3.0 | 6.0 | 53.7 | 3.0 | PRESENT | 343 | 0.39 | PASSED | Cu CIRCULAR PLATE PLACED ON LOWER SIDE |
| EXAMPLE 17 | 35.9 | 55.1 | 6.3 | 3.0 | 6.0 | 53.7 | 2.6 | PRESENT | 356 | 0.28 | PASSED | Cu RECTANGULAR PLATES PLACED ON UPPER AND LOWER SIDES |

FIG. 16

TABLE 6

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| EXAMPLE 18 | 35.9 | 55.1 | 6.3 | 3.0 | 6.0 | 53.7 | 3.1 | PRESENT | 365 | 0.32 | PASSED | Cu-Mn-Te TIP INFIL-TRATION |

FIG. 17

TABLE 7

| | Cu [wt%] | WC [wt%] | WC PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| EXAMPLE 19 | 35.9 | 55.1 | 6.3 | 3.0 | 6.0 | 53.7 | 2.5 | PRESENT | 320 | 0.27 | PASSED | SINTERING |

FIG. 18

TABLE 8

| | Cu [wt%] | W [wt%] | W PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 11 | 35.9 | 55.1 | 25.00 | 3.0 | 6.0 | 53.7 | 2.5 | PRESENT | 121 | - | - | CRACK AT TIME OF MACHINING |
| EXAMPLE 20 | 35.9 | 55.1 | 9.00 | 3.0 | 6.0 | 53.7 | 2.0 | PRESENT | 355 | 0.54 | PASSED | |
| EXAMPLE 21 | 35.9 | 55.1 | 1.00 | 3.0 | 6.0 | 53.7 | 3.3 | PRESENT | 366 | 0.45 | PASSED | |
| COMPARATIVE EXAMPLE 12 | 35.9 | 55.1 | 0.08 | 3.0 | 6.0 | 53.7 | - | - | - | - | - | UNABLE TO BE MOLDED |

TABLE 9

| METAL ELEMENT | PURE METAL | CARBIDE |
|---|---|---|
| W | 360 | 690 |
| Mo | 160 | 470 |
| Cr | 130 | 950 |
| Nb | 80 | 790 |
| Ta | 70 | 730 |
| Ti | 60 | 780 |
| V | 55 | 690 |

UNIT: Hv

FIG. 21

TABLE 10

| | Cu [wt%] | Mo [wt%] | Mo PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 13 | 35.9 | 55.1 | 150.00 | 3.0 | 6.0 | 53.7 | 3.2 | PRESENT | 72 | 0.61 | FAILED | |
| EXAMPLE 22 | 35.9 | 55.1 | 100.00 | 3.0 | 6.0 | 53.7 | 3.1 | PRESENT | 84 | 0.58 | PASSED | |
| EXAMPLE 23 | 35.9 | 55.1 | 25.00 | 3.0 | 6.0 | 53.7 | 2.6 | PRESENT | 183 | 0.64 | PASSED | |
| EXAMPLE 24 | 35.9 | 55.1 | 0.50 | 3.0 | 6.0 | 53.7 | 2.5 | PRESENT | 330 | 0.65 | PASSED | |
| COMPARATIVE EXAMPLE 14 | 35.9 | 55.1 | 0.08 | 3.0 | 6.0 | 53.7 | – | – | – | – | – | UNABLE TO BE MOLDED |

FIG. 22

TABLE 11

| | Cu [wt%] | Cr [wt%] | Cr PARTICLE DIAMETER [μm] | Mn [wt%] | Te [wt%] | Mn/(Mn+Te) [at%] | AMOUNT OF Mn SOLID-DISSOLVED IN Cu [at%] | PRESENCE OF MnO | MAXIMUM BENDING STRESS [MPa] | CHOPPING CURRENT VALUE [A] | INTER-RUPTION TEST | NOTES |
|---|---|---|---|---|---|---|---|---|---|---|---|---|
| COMPARATIVE EXAMPLE 15 | 35.9 | 55.1 | 120.00 | 3.0 | 6.0 | 53.7 | 2.8 | PRESENT | 61 | 0.44 | FAILED | |
| EXAMPLE 25 | 35.9 | 55.1 | 100.00 | 3.0 | 6.0 | 53.7 | 2.2 | PRESENT | 78 | 0.39 | PASSED | |
| EXAMPLE 26 | 35.9 | 55.1 | 25.00 | 3.0 | 6.0 | 53.7 | 2.6 | PRESENT | 193 | 0.45 | PASSED | |
| EXAMPLE 27 | 35.9 | 55.1 | 10.00 | 3.0 | 6.0 | 53.7 | 2.3 | PRESENT | 243 | 0.48 | PASSED | |
| EXAMPLE 28 | 35.9 | 55.1 | 0.50 | 3.0 | 6.0 | 53.7 | 2.7 | PRESENT | 258 | 0.42 | PASSED | |
| COMPARATIVE EXAMPLE 16 | 35.9 | 55.1 | 0.08 | 3.0 | 6.0 | 53.7 | – | – | – | – | – | UNABLE TO BE MOLDED |

ELECTRIC CONTACT AND VACUUM INTERRUPTER USING SAME

TECHNICAL FIELD

The present invention relates to: a vacuum interrupter used for a vacuum circuit breaker which is a piece of high-voltage power distributing equipment; and an electric contact used for the vacuum interrupter.

BACKGROUND ART

A vacuum circuit breaker which is a piece of high-voltage power distributing equipment is used for interrupting current when the high-voltage power distributing equipment has malfunctioned or is abnormal. The vacuum circuit breaker includes a vacuum interrupter having a function of interrupting current. The vacuum interrupter has a structure in which a fixed electrode and a movable electrode are coaxially disposed so as to face each other on the inside of an insulation container kept at high vacuum.

When overload current or short-circuit current is generated in the power distributing equipment, these electrodes are instantaneously opened to interrupt the current. However, since an arc is generated between the electrodes, current is not instantaneously interrupted. When AC current is interrupted, an arc becomes weaker in accordance with decrease in the AC current and is extinguished, whereby interruption is achieved. In this manner, a phenomenon occurs in which, at a time before AC current becomes zero, the current is instantaneously interrupted. The phenomenon is called chopping.

High surge voltage called switching surge is generated at the time of chopping. If a capacitive or inductive device is connected to the power distributing equipment, the high surge voltage may damage the device. In order to reduce the surge voltage, current at the time of occurrence of chopping (chopping current) needs to be reduced. Chopping current can be reduced by causing an arc generated between the electrodes at the time of opening to continue to near the zero point of AC current.

The arc continuation is dependent on the number of particles in vacuum, and particles need to be supplied into the vacuum at the time of chopping. Two types of particles, i.e., metal particles and thermal electrons, can be supplied. A mixture of Ag which is an electrically conductive component and a high-melting-point metal or a carbide thereof (WC or the like), is selected as a conventional electric contact material having a low chopping current characteristic. This is because evaporation of Ag which is an electrically conductive component and emission of thermal electrons from a high-melting-point metal or a carbide thereof are promoted by a generated arc heating the electrodes, whereby the arc is caused to continue.

According to the Richardson-Dushman equation expressing thermal electron emission capacity with current density, a thermal electron emission capacity is known to be dependent on the work function and the temperature of the material. In particular, the contribution ratio of the temperature is high. Therefore, high-melting-point metals and carbides thereof are widely used because of the high melting points thereof. From the above-described viewpoint, vacuum interrupters in which Ag-WC electric contacts that exhibit excellent low chopping current characteristics are used, have been developed and put into practical use.

In conventional vacuum interrupters, stable low chopping characteristics are obtained through addition of Te, Se, or the like to an electric contact material containing, as an electrically conductive component, Cu instead of Ag from a viewpoint of cost reduction (see, for example, Patent Documents 1 and 2). The reason is as follows. Since Te and Se have very low boiling points among metals, a large amount of the low-boiling-point metal is evaporated by the electrodes being heated owing to arc exposure, whereby the arc continuation is enabled.

CITATION LIST

Patent Document

Patent Document 1: Japanese Laid-Open Patent Publication No. 2007-332429 (page 3, FIG. 2)

Patent Document 2: Japanese Laid-Open Patent Publication No. 2014-56784 (page 4, FIG. 2)

SUMMARY OF THE INVENTION

Problems to be Solved by the Invention

Conventional electric contacts in which Cu is used as an electrically conductive component exhibit low chopping current characteristics owing to the addition of a low-boiling-point metal. However, selective evaporation of the low-boiling-point metal can be interpreted also as wear of the electric contact material. Therefore, as the number of times of opening and closing increases, the low-boiling-point metal wears. Accordingly, the amount of metal vapor supplied to a space between the contacts decreases, and the low chopping current characteristics deteriorate.

Increase of the addition amount of the low-boiling-point metal is considered as a measure against this problem. However, excessive addition of the low-boiling-point metal makes the electric contact brittle. Accordingly, excessive addition of the low-boiling-point metal poses another problem of generating a crack at the time of the opening or processing of the electric contact. Therefore, conventional electric contacts in which the low-boiling-point metal is added cannot simultaneously satisfy ensuring of a low chopping current characteristic and mechanical strength.

The present invention has been made to solve the above-described problems, and an object of the present invention is to simultaneously satisfy ensuring of a low chopping current characteristic and mechanical strength in an electric contact in which a low-boiling-point metal is added.

Solution to the Problems

An electric contact according to the present invention includes: a base material in which higher than 0 at % and not higher than 10 at % of Mn is solid-dissolved with respect to 100 at % of Cu; high-melting-point substance particles which are dispersed in the base material and which are at least either of particles of a metal and particles of a carbide of the metal; and an intermetallic compound containing X atoms (X represents Te or Se) and dispersed in the base material. The metal is at least one metal selected from among W, Ta, Cr, Mo, Nb, Ti, and V. If a Vickers hardness of the high-melting-point substance particles is not lower than 0 Hv and lower than 200 Hv, a particle diameter of the high-melting-point substance particles is larger than 0.1 μm and not larger than 100 μm. If the Vickers hardness of the high-melting-point substance particles is not lower than 200 Hv, the particle diameter is not smaller than 0.1 μm and not larger than 10 μm. If a mass of an entirety is defined as 100 mass %, a mass of the high-melting-point substance particles is not lower than 20 mass % and not higher than 80 mass %, a mass of the X atoms is not lower than 1.5 mass % and not higher than 15 mass %, and a remainder is the base material. The intermetallic compound contains a MnX compound, and a compound of a Mn—Cu solid-solution phase and X. An atomic weight ratio Mn/(Mn+X) is not lower than 20 at % and not higher than 80 at %.

Effect of the Invention

According to the present invention, in the electric contact including the base material, the high-melting-point substance particles, and the intermetallic compound, the intermetallic compound containing MnX (X represents Te or Se), the MnX compound, and the compound of the Mn—Cu solid-solution phase and X, is dispersed in the base material. If the Vickers hardness of the high-melting-point substance particles is higher than 0 HV and lower than 200 Hv, the particle diameter of the high-melting-point substance particles is not smaller than 0.1 μm and not larger than 100 μm. If the Vickers hardness of the high-melting-point substance particles is not lower than 200 Hv, the particle diameter is not smaller than 0.1 μm and not larger than 10 μm. If the mass of the entirety is defined as 100 mass %, the mass of the high-melting-point substance particles is not lower than 20 mass % and not higher than 80 mass %, and the mass of the X atoms is not lower than 1.5 mass % and not higher than 15 mass %. The atomic weight ratio Mn/(Mn+X) is not lower than 20 at % and not higher than 80 at %. Accordingly, it is possible to simultaneously satisfy ensuring of a low chopping current characteristic and mechanical strength.

BRIEF DESCRIPTION OF THE DRAWINGS

FIG. 2 is a table indicating the compositions and the characteristics of electric contacts according to Embodiment 1 of the present invention.

FIG. 3 is a table indicating the compositions and the characteristics of electric contacts according to Embodiment 1 of the present invention.

FIG. 4 is a table indicating the compositions and the characteristics of electric contacts according to Embodiment 1 of the present invention.

FIG. 5 is a table indicating the compositions and the characteristics of electric contacts according to Embodiment 1 of the present invention.

FIG. 6 is a table indicating the compositions and the characteristics of electric contacts according to Embodiment 1 of the present invention.

FIG. 16 is a characteristic table of an electric contact according to Embodiment 2 of the present invention.

FIG. 17 is a characteristic table of an electric contact according to Embodiment 3 of the present invention.

FIG. 18 is a table indicating the compositions and the characteristics of electric contacts according to Embodiment 4 of the present invention.

FIG. 21 is a table indicating the compositions and the characteristics of electric contacts according to Embodiment 5 of the present invention.

FIG. 22 is a table indicating the compositions and the characteristics of electric contacts according to Embodiment 5 of the present invention.

DESCRIPTION OF EMBODIMENTS

Embodiment 1

Figure 1:
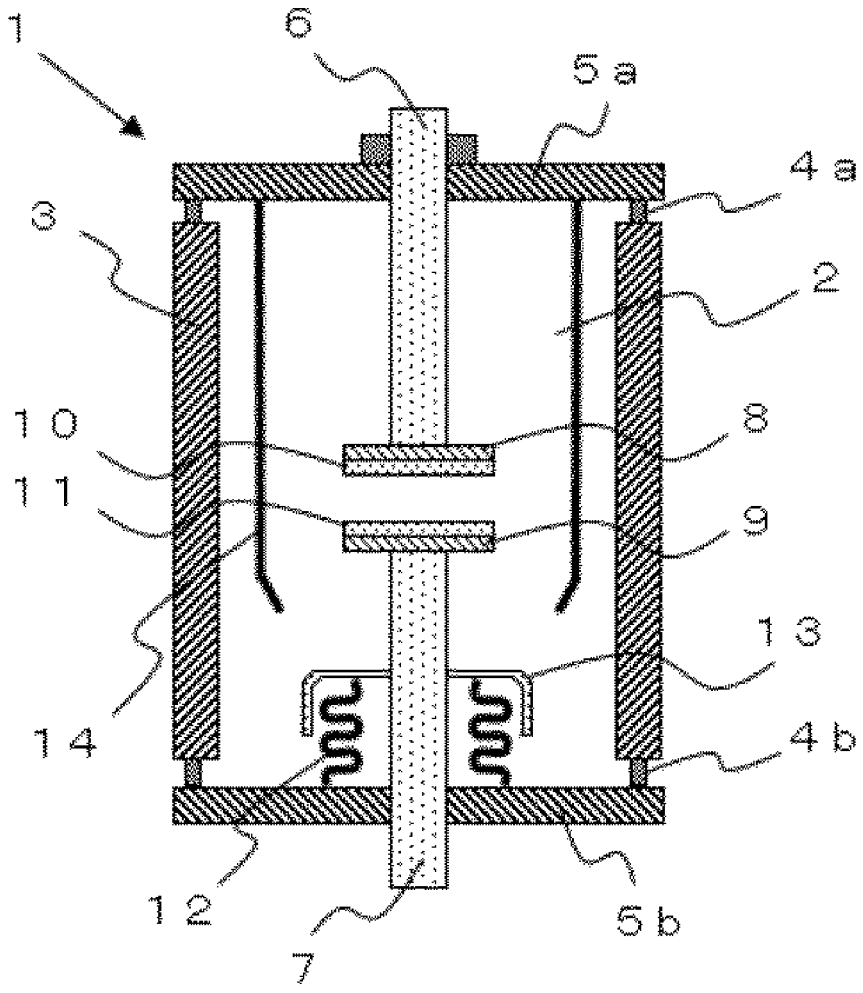
FIG. 1 is a schematic view of a vacuum interrupter according to Embodiment 1 of the present invention.

FIG. 1 is a schematic sectional view of a vacuum interrupter according to Embodiment 1 of the present invention. A vacuum interrupter 1 according to the present embodiment includes an interruption chamber 2. The interruption chamber 2 is composed of a cylindrical insulation container 3 and metal lids 5*a* and 5*b* fixed to both ends of the insulation container 3 by means of sealing metal members 4*a* and 4*b*. The inside of the interruption chamber 2 is kept vacuum and airtight. In the interruption chamber 2, a fixed electrode rod 6 and a movable electrode rod 7 are attached so as to face each other. A fixed electrode 8 and a movable electrode 9 are mounted by brazing to ends of the fixed electrode rod 6 and the movable electrode rod 7, respectively. A bellows 12 is attached to the movable electrode rod 7 and allows the movable electrode 9 to axially move while the inside of the interruption chamber 2 is kept vacuum and airtight. When the movable electrode 9 axially moves, the movable electrode 9 comes into contact with and becomes apart from the fixed electrode 8. A fixed electric contact 10 and a movable electric contact 11 are mounted by brazing to contact portions of the fixed electrode 8 and the movable electrode 9, respectively. A bellows arc shield 13 made of a metal is provided to an upper part of the bellows 12. The bellows arc shield 13 prevents arc vapor from adhering to the bellows 12. An insulation container arc shield 14 made of a metal is provided in the interruption chamber 2 so as to cover the fixed electrode 8 and the movable electrode 9. The insulation container arc shield 14 prevents arc vapor from adhering to the inner wall of the insulation container 3. An electric contact according to the present embodiment is used as at least either of the fixed electric contact 10 and the movable electric contact 11 which are attached to the fixed electrode 8 and the movable electrode 9, respectively.

In general, the fixed electrode 8 and the movable electrode 9, and the fixed electric contact 10 and the movable electric contact 11, each have a disc shape. Hereinafter, description is made with the shape of the electric contact according to the present embodiment being a disc shape.

First, a method for producing the electric contact according to the present embodiment will be described. The electric contact according to the present embodiment is produced through: a step of mixing raw material powders and pressing the mixture powder with a desired press mold to produce a molded body; a step of calcining the molded body to obtain a sintered body; a step of infiltrating the sintered body with Cu to obtain an infiltrated body; and a step of processing the obtained infiltrated body into a desired shape to obtain an electric contact. Hereinafter, the method for producing the electric contact according to the present embodiment will be described in detail.

In the step of mixing raw material powders and pressing the mixture powder with a desired press mold to produce a molded body, Cu powder, WC powder, Mn powder, and Te powder are mixed, and the mixture powder is pressurized and molded with a pressing machine, to obtain a Cu—WC—Mn—Te molded body. Adjustment is performed such that, if the mass of the mixture powder is defined as 100 mass %, the mass of the WC powder is 20 to 80 mass %, the mass of the Te powder is 1.5 to 15 mass %, and the remainder is the masses of the Cu powder and the Mn powder. At this time, the mass of the Mn powder is adjusted such that the atomic weight ratio Mn/(Mn+Te) is not lower than 25 and not higher than 80.

In general, if powder, such as WC particles, that is hard and not plastically deformable becomes fine, the specific surface area of the powder increases. Thus, when powders are pressurized and molded, a large number of voids are present near the contact points between the powders, and it becomes difficult to achieve densification. Therefore, if the particle diameter is small, the press molding pressure for obtaining a molded body having a desired density becomes excessively high, whereby a crack may be generated at the time of molding. Accordingly, the average particle diameter of the WC powder is preferably not smaller than 0.1 μm.

As the average particle diameter of each raw material powder, for example, an average particle diameter in a particle size distribution measured by a laser diffraction type particle size distribution device is adopted.

In the step of calcining the molded body to obtain a sintered body, the Cu—WC—Mn—Te molded body is sintered at 500 to 950° C. in a hydrogen atmosphere or under a vacuum at not greater than $1\times10^{-5}$ Pa. The temperature for the sintering only has to be lower than 988° C., which is the boiling point of Te, by at least 30° C.

In the step of infiltrating the sintered body with Cu to obtain an infiltrated body, a Cu circular plate or a Cu rectangular plate having a size equal to or smaller than that of the sintered body is placed directly on the lower side of the sintered body, and the sintered body is infiltrated at a temperature not lower than the melting point of Cu (1083° C.) and lower than 1130° C. in a hydrogen atmosphere or under a vacuum at not greater than $1\times10^{-5}$ Pa. If the temperature for the infiltration is not lower than 1130° C., the temperature is higher than the melting point of an intermetallic compound, of a low-boiling-point metal, which is present in the sintered body. Thus, Te starts to sublime, whereby the sintered body may swell and a dense electric contact may not be obtained. Either of the sintered body and the Cu circular plate or the Cu rectangular plate may be disposed on the upper side of the other. Alternatively, the sintered body may be disposed so as to be held between two Cu circular plates from above and below.

In the step of processing the infiltrated body into a desired shape to obtain an electric contact, the contact material is ground until coming to have a thickness and a diameter that are necessary in terms of design, as the fixed electric contact or the movable electric contact for the vacuum interrupter. Lastly, an end of the contact material is tapered or the surface of the contact material is polished, to obtain an electric contact.

Next, the present invention will be described more in detail by means of examples and comparative examples.

Example 1

Cu powder having an average particle diameter of 10 μm, WC powder having an average particle diameter of 6.3 μm, Te powder having an average particle diameter of 40 μm, and Mn powder having an average particle diameter of 30 μm, were mixed for 30 minutes using a ball mill or the like, to produce a uniform mixture powder. The obtained mixture powder was put into a die (made of steel) having an inner diameter φ of 23 mm, and was pressurized and molded at a pressure of 400 Mpa using a hydraulic pressing machine, to produce a molded body having a thickness of 5 mm. The obtained molded body was sintered for two hours at 900° C. in a hydrogen atmosphere, to produce a sintered body. The obtained sintered body was placed on the upper side of a Cu circular plate having a thickness of 2 mm and a diameter φ of 20 mm, and was infiltrated for two hours at 1110° C. in a hydrogen atmosphere, to obtain an electric contact of Example 1. The mass ratio between the Cu powder, the WC powder, the Te powder, and the Mn powder was adjusted at the time of production of the mixture powder, thereby adjusting the composition of the electric contact. FIG. 2 (Table 1) indicates the composition of the electric contact obtained in Example 1.

Examples 2 to 12

Electric contacts were produced by the same procedure as that for Example 1. However, the mass ratio between the powders was adjusted at the time of production of the mixture powders such that the electric contacts had different composition ratios. FIG. 2 (Table 1) indicates the compositions of the electric contacts obtained in Examples 2 to 4. FIG. 3 (Table 2) indicates the compositions of the electric contacts obtained in Examples 5 to 8. FIG. 4 (Table 3) indicates the compositions of the electric contacts obtained in Examples 9 to 12.

Comparative Examples 1 to 7

Electric contacts were produced by the same procedure as that for Example 1. However, the mass ratio between the powders was adjusted at the time of production of the mixture powders such that the electric contacts had different composition ratios. FIG. 2 (Table 1) indicates the compositions of the electric contacts obtained in Comparative Examples 1 to 3. FIG. 3 (Table 2) indicates the compositions of the electric contacts obtained in Comparative Examples 4 and 5. FIG. 4 (Table 3) indicates the compositions of the electric contacts obtained in Comparative Examples 6 and 7.

Example 13

An electric contact was produced by the same procedure as that for Example 1, except that WC powder having an average particle diameter of 9 μm was used instead of the WC powder having an average particle diameter of 6.3 μm in Example 1. FIG. 5 (Table 4) indicates the composition of the electric contact obtained in Example 13.

Example 14

An electric contact was produced by the same procedure as that for Example 1, except that WC powder having an average particle diameter of 3 μm was used instead of the WC powder having an average particle diameter of 6.3 μm in Example 1. FIG. 5 (Table 4) indicates the composition of the electric contact obtained in Example 14.

Example 15

An electric contact was produced by the same procedure as that for Example 1, except that WC powder having an average particle diameter of 1 μm was used instead of the WC powder having an average particle diameter of 6.3 μm in Example 1. FIG. 5 (Table 4) indicates the composition of the electric contact obtained in Example 15.

Comparative Example 8

An electric contact was produced by the same procedure as that for Example 1, except that WC powder having an average particle diameter of 25 μm was used instead of the WC powder having an average particle diameter of 6.3 μm in Example 1. FIG. 5 (Table 4) indicates the composition of the electric contact obtained in Comparative Example 8.

Comparative Example 9

An electric contact was produced by the same procedure as that for Example 1, except that WC powder having an average particle diameter of 12 μm was used instead of the WC powder having an average particle diameter of 6.3 μm in Example 1. FIG. 5 (Table 4) indicates the composition of the electric contact obtained in Comparative Example 9.

Comparative Example 10

An electric contact was produced by the same procedure as that for Example 1, except that WC powder having an average particle diameter of 0.08 μm was used instead of the WC powder having an average particle diameter of 6.3 μm in Example 1. FIG. 5 (Table 4) indicates the composition of The electric contact obtained in Comparative Example 9.

Example 16

An electric contact was produced by the same procedure as that for Example 1, except that the sintered body was infiltrated not in a state of being placed on the upper side of the Cu circular plate as in Example 1 but in a state of being placed on the lower side of the Cu circular plate. FIG. 6 (Table 5) indicates the composition of the electric contact obtained in Example 16.

Example 17

An electric contact was produced by the same procedure as that for Example 1, except that the sintered body was infiltrated not in a state of being placed on the upper side of the Cu circular plate having a thickness of 2 mm and a diameter φ of 20 mm as in Example 1 but in a state of being held between Cu rectangular plates each having a thickness of 1 mm and vertical and horizontal lengths of 18 mm. FIG. 6 (Table 5) indicates the composition of the electric contact obtained in Example 17.

Figure 7:
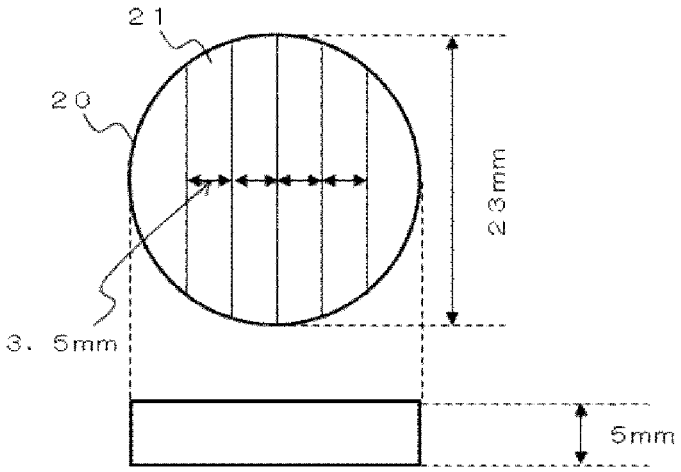
FIG. 7 is a schematic view of test pieces in a strength test in Embodiment 1 of the present invention.
Figure 8:
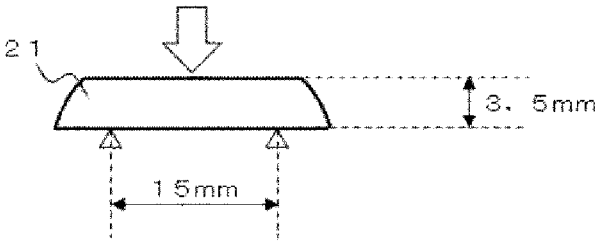
FIG. 8 is a schematic view explaining a method for the strength test in Embodiment 1 of the present invention.

Next, evaluations of the mechanical strengths of the electric contacts will be described. FIG. 7 is a schematic view of test pieces in a strength test in the present embodiment. The electric contact obtained in each of the examples and the comparative examples had such a shape that the thickness was 5 mm and the diameter φ was 23 mm. As shown in FIG. 7, the electric contact 20 obtained in each of the examples and the comparative examples was sliced into four test pieces 21 each having a width of 3.5 mm. FIG. 8 is a schematic view explaining a method for the strength test in the present embodiment. Load was applied in the thickness direction to each test piece 21 having a width of 3.5 mm, a thickness of 5 mm, and a length of about 23 mm, with the distance between supports being 15 mm. In doing so, the load at which the test piece was fractured was measured, thereby calculating a maximum bending stress. The average value of the maximum bending stresses of the four test pieces was used as the maximum bending stress of the example or the comparative example.

Next, evaluations of the chopping characteristics and the interruption characteristics of the electric contacts will be described. The electric contact obtained in each of the examples and the comparative examples and having a thickness of 5 mm and a diameter φ of 23 mm was machined, to produce a test contact having a thickness of 3 mm and a diameter φ of 20 mm. Then, a portion, of the test contact, that extended inward from the end of the test contact by 2 mm was tapered so as to be tilted at about 15° with respect to the surface. Two such test contacts were produced, and an evaluation vacuum interrupter was assembled using the test contacts as the fixed contact and the movable contact, respectively. A chopping current test and an interruption current test were performed on the evaluation vacuum interrupter, and the chopping characteristic and the interruption characteristic of the example or the comparative example were evaluated.

In the chopping current test, a circuit in which a resistor (20Ω) and the evaluation vacuum interrupter were connected in series to each other, was constructed and energized by current of 10 A using a power supply (AC 200 V), and the vacuum interrupter was opened from a closed state. At this time, a current obtained immediately before an arc current became zero was measured, and the measured current was used as a chopping current. The chopping current test was performed 1000 times using the same vacuum interrupter, and the average value thereof was used as the chopping current value of the example or the comparative example. The chopping current value needs to be not greater than 1 A from a viewpoint of avoiding damage to an electrical device due to increase in surge voltage generated at the time of interruption.

In the interruption test, a circuit in which a thyristor and the evaluation vacuum interrupter were connected in series to each other, was constructed. In a state where the vacuum interrupter was closed, energization current obtained using electrical discharge from a capacitor bank was caused to flow, and the vacuum interrupter was opened. At this time, pass or failure of the interruption test was determined according to whether or not interruption was normally performed. The capacitor bank is charged by an external power supply. The interruption test was performed with the energization current being increased from 2 kA in steps of 1 kA. Pass or failure of the interruption test was determined at the time at which the interruption test was successful at 4 kA. The phrase "the interruption test was successful" means a state where neither restrike nor arc continuation occurred when the vacuum interrupter was opened. FIGS. 2 to 6 (Tables 1 to 5) indicate the chopping currents as chopping characteristics, and pass and failure of the interruption tests as interruption characteristics.

Figure 9:
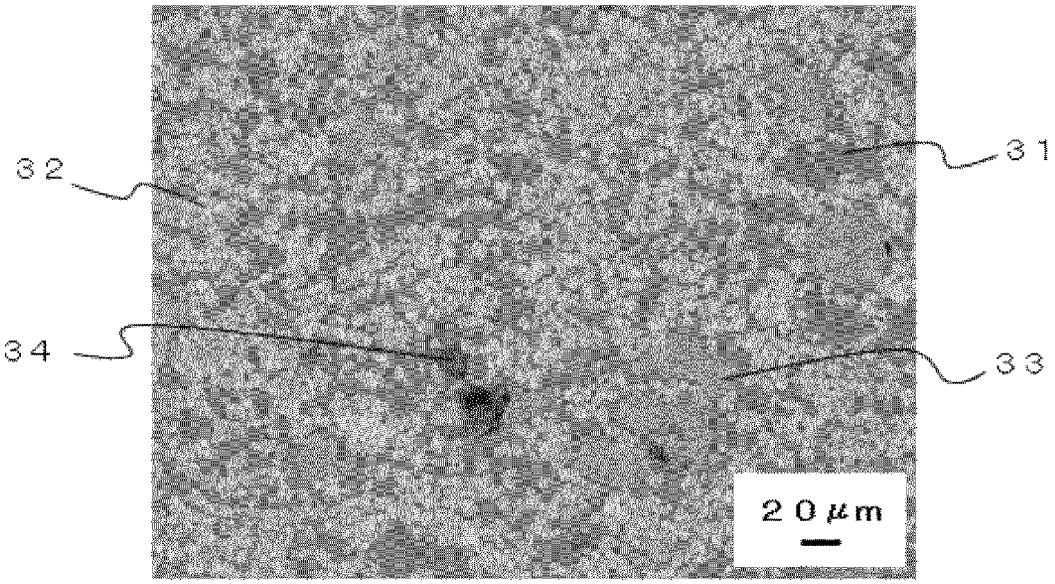
FIG. 9 is a sectional view of an electric contact according to Embodiment 1 of the present invention.

FIG. 9 is a sectional view of the internal compositional structure of the electric contact produced in Example 1 of the present embodiment. FIG. 9 is a sectional photograph of the electric contact observed using a scanning electron microscope (SEM). A composition distribution of the internal structure was measured using a function of composition analysis through wavelength dispersive X-ray spectroscopy or energy dispersive X-ray spectroscopy by the scanning electron microscope. As shown in FIG. 9, WC particles 32 which are high-melting-point substance particles, a Mn—Cu—Te intermetallic compound 33, and MnO particles 34 are dispersed in a base material 31 containing Cu as an electrically conductive component. As a result of analysis of the composition of the Mn—Cu—Te intermetallic compound 33 using an X-ray diffractometer (XRD), it is found that, since MnTe, $Cu_2Te$, Mn, and Cu were solid-dissolved with one another, (Mn,Cu)Te and $(Mn,Cu)_2Te$ resulting from peak shifts respectively from original MnTe and $Cu_2Te$ were formed.

The particle diameter of the WC particles was calculated from the sectional photograph, shown in FIG. 9, of the electric contact observed using the scanning electron microscope. For example, a straight line is arbitrarily drawn on the obtained sectional photograph, and the number of WC particles on the straight line and the length on the WC particles are measured. The length on the WC particles is divided by the number of the WC particles, to obtain the average particle diameter of the WC particles. In the present embodiment, a plurality of straight lines were arbitrarily drawn, and the average value of average particle diameters obtained from the plurality of straight lines was used as the particle diameter of the WC particles. Alternatively, since the WC particles appear in white in the image unlike the other particles, the sectional photograph may be binarized, and a particle size distribution may be calculated by image processing.

Figure 10:
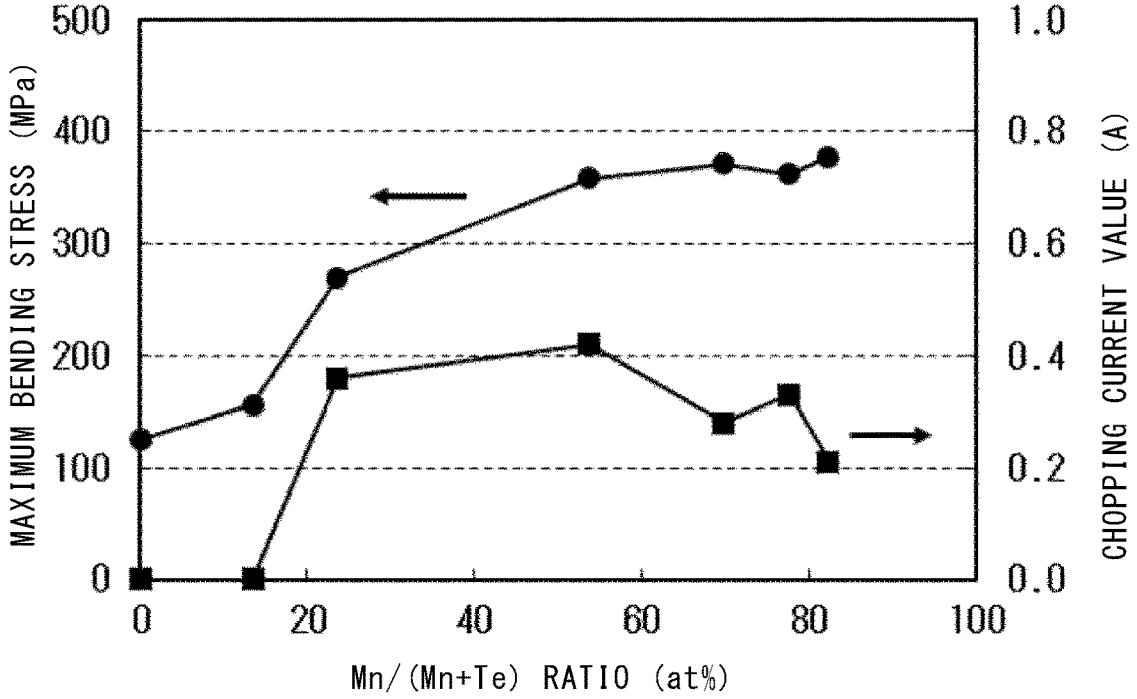
FIG. 10 is a characteristic graph of the electric contacts according to Embodiment 1 of the present invention.

FIG. 10 is a characteristic graph indicating the compositions and the characteristics in the examples and the comparative examples indicated in FIG. 2 (Table 1). In FIG. 2 (Table 1), the composition ratio of the WC particles, the particle diameter of the WC particles, and the composition ratio of Te are fixed. Thus, Mn/(Mn+Te) ratio is used as the horizontal axis, and maximum bending stress and chopping current value are used as the vertical axes.

The electric contact of Example 1 in which Mn/(Mn+Te) was 23.6 at %, had a maximum bending stress of 269 MPa and was successfully processed without generation of any crack at the time of the processing of the electric contact. Meanwhile, the electric contact in which Mn/(Mn+Te) was 0 at % (Comparative Example 1) and the electric contact in which Mn/(Mn+Te) was 13.4 at % (Comparative Example 2), had maximum bending stresses of 124 MPa and 156 MPa, respectively, and had insufficient strengths. Accordingly, cracks were generated at the time of processing of the electric contacts. Therefore, neither the chopping test nor the interruption test were able to be performed. The maximum bending strength needs to be not less than 200 MPa from a viewpoint of stable processability of the electric contact.

Electric contacts with increased composition ratios of Mn, i.e., the electric contact in which Mn/(Mn+Te) was 53.7 at % (Example 2), the electric contact in which Mn/(Mn+Te) was 69.9 at % (Example 3), and the electric contact in which Mn/(Mn+Te) was 77.7 at % (Example 4), had maximum bending stresses of 358 MPa, 371 MPa, and 362 MPa, respectively, and had more improved strengths than that in Example 1. This is thought to be because the addition of Mn allowed suppression of generation of brittle $Cu_2Te$, and MnTe that had a NiAs-type crystal structure and that did not induce any cleavage fracture was generated, thereby being capable of inhibiting the electric contact from becoming brittle. From Mn and Te, a MnTe intermetallic compound in which Mn and Te are bound to each other with the atomic weight ratio therebetween being 1:1, is generated. Thus, it is found that the strength of the contact increases according to the amount of added Mn at Mn/(Mn+Te) not higher than 50 at %, and meanwhile, the mechanical strength is saturated at Mn/(Mn+Te) not lower than 50 at %. All the chopping current values are 1 A or less, and thus it is found that each of the electric contacts has a low chopping characteristic. In addition, it is found that Mn in the electric contact reacted with a very small amount of oxygen that was present during heating treatment, and not higher than 5 at % of MnO was generated. Accordingly, it is found that Mn functions as a sacrificial material for inhibiting Te, which is a low-boiling-point metal effective in the chopping value, from becoming $TeO_2$.

Meanwhile, the electric contact in which Mn/(Mn+Te) was 82.3 at % (Comparative Example 3) failed the interruption test, and failures of interruption at a current value of 4 kA were seen here and there. This is thought to be because the composition ratio of Mn became excessive, the amount of Mn solid-dissolved in Cu increased, the conductance of the electric contact decreased, and heat generated at the time of interruption became difficult to be dissipated, whereby an arc failed to be interrupted and a restrike was generated.

According to the above-described results, the Mn/(Mn+Te) ratio needs to be not lower than 20 at % and not higher than 80 at %.

Figure 11:
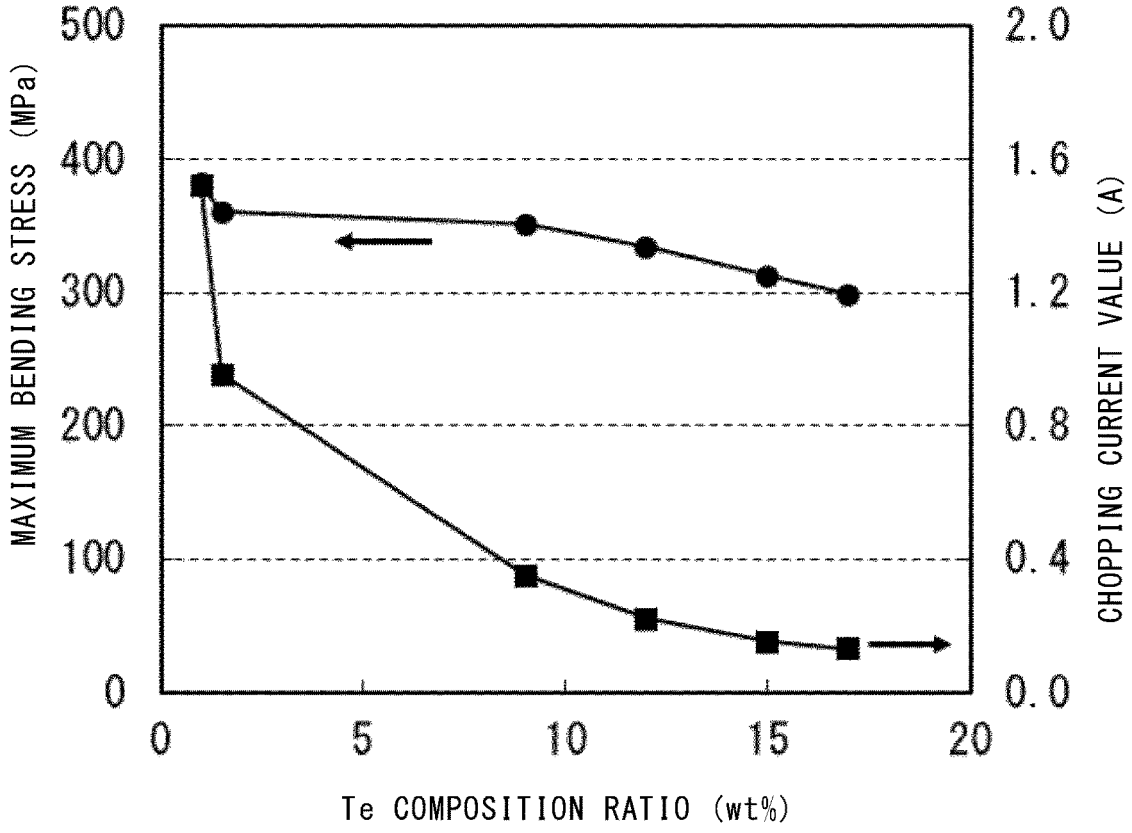
FIG. 11 is a characteristic graph of the electric contacts according to Embodiment 1 of the present invention.

FIG. 11 is a characteristic graph indicating the compositions and the characteristics in the examples and the comparative examples indicated in FIG. 3 (Table 2). In FIG. 3 (Table 2), the composition ratio of the WC particles, the particle diameter of the WC particles, and the Mn/(Mn+Te) ratio are fixed. Thus, the composition ratio (mass %) of Te is used as the horizontal axis, and maximum bending stress and chopping current value are used as the vertical axes.

The electric contact in which the composition ratio of Te was set to 1.0 mass % (wt %) (Comparative Example 4) had a chopping current value of 1.52 A, and had low chopping performance. This is thought to be because the amount of Te which was a low-boiling-point metal was small, and thus metal vapor enough to cause arc continuation failed to be generated.

The electric contacts in which the composition ratios of Te were set to 1.5 to 15.0 mass % (Examples 5 to 8), each had a chopping current value not greater than 1 A and had improved chopping performances.

Meanwhile, the electric contact in which the composition ratio of Te was set to 17.0 mass % (Comparative Example 5) had a chopping current value not greater than 1 A and had improved chopping performance, but failed the interruption test. The reason is thought to be that the amount of Te which was a low-boiling-point metal was large and the amount of generated metal vapor increased, whereby an arc failed to be interrupted at a current value of 4 kA and a restrike was generated.

Since Mn/(Mn+Te) was fixed at 53.7 mass %, the electric contact was inhibited from becoming brittle owing to generation of $Cu_2Te$, and no crack was generated in the contact. If the composition ratio of Te increases, a MnTe compound is generated in the electric contact, and thus the proportion of the interface with the base material increases. Therefore, the maximum bending stress tended to decrease. However, there was no practical problem.

According to the above-described results, the composition ratio of Te needs to be not lower than 1.5 mass % and not higher than 15 mass %.

Figure 12:
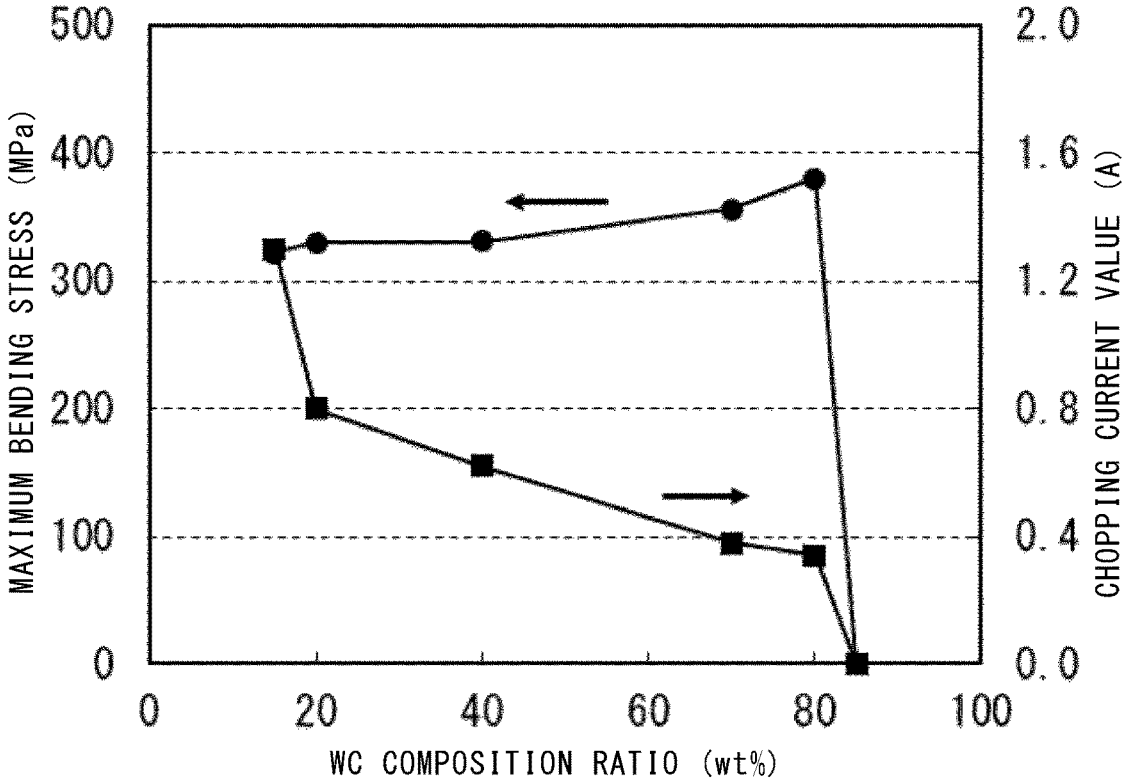
FIG. 12 is a characteristic graph of the electric contacts according to Embodiment 1 of the present invention.

FIG. 12 is a characteristic graph indicating the compositions and the characteristics in the examples and the comparative examples indicated in FIG. 4 (Table 3). In FIG. 3 (Table 2), the particle diameter of the WC particles, the composition ratio of Mn, and the Mn/(Mn+Te) ratio are fixed. Thus, the composition ratio (mass %) of the WC particles is used as the horizontal axis, and maximum bending stress and chopping current value are used as the vertical axes.

The electric contacts in which the composition ratios of the WC particles were set to 20 to 80 mass % (Examples 9 to 12), each passed the interruption test while having a chopping current value not greater than 1 A, and had favorable electric characteristics.

Meanwhile, the electric contact in which the composition ratio of the WC particles was set to 15 mass % (Comparative Example 6), had a chopping current value of 1.3 A and had low chopping performance. This is assumed to be because the amount of thermal electron emission was small with the composition ratio of the WC particles being 15 mass %. In the electric contact in which the composition ratio of the WC particles was set to 85 mass % (Comparative Example 7), an excessive amount of hard WC particles was present in the mixture powder, and thus plastically deforming Cu became relatively less. Therefore, when a molded body was taken out from a die at the time of production of the molded body, this taking out resulted in concurrent breakage of the molded body.

According to the above-described results, the composition ratio of the WC particles needs to be not lower than 20 mass % and not higher than 80 mass %.

Figure 13:
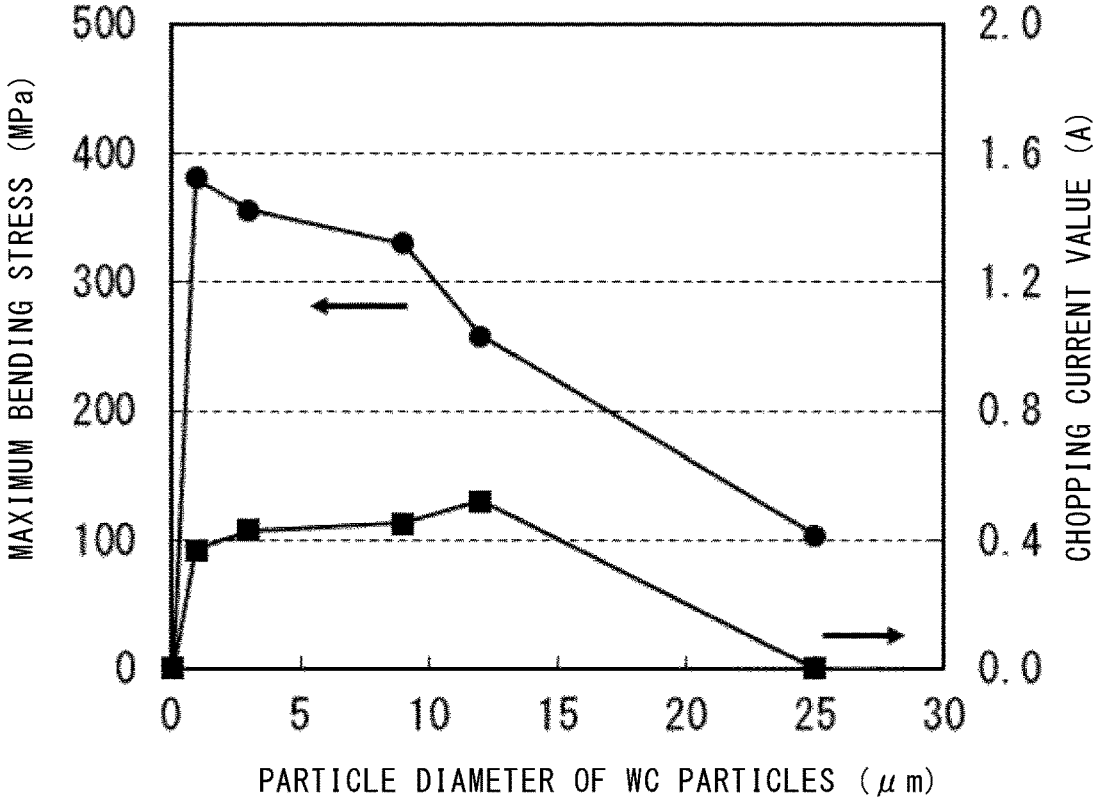
FIG. 13 is a characteristic graph of the electric contacts according to Embodiment 1 of the present invention.

FIG. 13 is a characteristic graph indicating the compositions and the characteristics in the examples and the comparative examples indicated in FIG. 5 (Table 4). In FIG. 3 (Table 2), the composition ratio (mass %) of the WC particles, the composition ratio of Mn, and the Mn/(Mn+Te) ratio are fixed. Thus, the particle diameter (μm) of the WC particles is used as the horizontal axis, and maximum bending stress and chopping current value are used as the vertical axes.

The electric contacts in which the particle diameters of the WC particles were set to 1 to 9 μm (Examples 13 to 25), had no problem in chopping performance and interruption performance. In addition, no crack was generated at the time of processing, or no breakage occurred at the time of production of a molded body.

Meanwhile, the electric contact in which the particle diameter of the WC particles was set to 25 μm (Comparative Example 8), had such a low maximum bending stress as to be 103 MPa, and a crack was generated in the electric contact at the time of processing of the contact, resulting in insufficient strength for practical use. This is thought to be because the interface between the base material and the WC particles of the electric contact became coarse owing to coarse WC particles, and breakage progressed from this interface. The electric contact in which the particle diameter of the WC particles was set to 12 μm (Comparative Example 9), had a maximum bending stress of 258 MPa and had no problem in mechanical strength, but failed the interruption test. This is thought to be because the WC particles becoming large caused the surface of the electric contact to be more uneven, and thus arcs generated at the time of interruption were locally concentrated, whereby the arcs failed to be interrupted at a current value of 4 kA and a restrike was generated.

In the electric contact in which the particle diameter of the WC particles was set to 0.08 μm (Comparative Example 10), a crack was generated at the time of production of the molded body. In general, if powder, such as the WC particles, that is hard and not plastically deformable becomes fine, the specific surface area of the powder increases. Thus, when powders are pressurized and molded, a large number of voids are present near the contact points between the powders, and it becomes difficult to achieve densification. Therefore, the molding pressure needs to be high in order to obtain a desired molded body. It is considered that, since more molding pressure than necessary was applied, deformation occurred and the crack was generated in the molded body.

According to the above-described results, the particle diameter of the WC particles needs to be not smaller than 0.1 μm and not larger than 10 μm.

In Example 16 indicated in FIG. 5 (Table 4), infiltration was performed with the Cu circular plate being disposed on the lower side of the molded body. In Example 17 indicated in FIG. 5 (Table 4), infiltration was performed with the Cu rectangular plates being disposed on the upper side and the lower side of the molded body. No difference from Example 1 in which infiltration was performed with the Cu circular plate being disposed on the upper side of the molded body, was observed in terms of mechanical strength, chopping characteristic, and interruption characteristic.

According to the examples and the comparative examples, it is possible to simultaneously satisfy ensuring of a low chopping current characteristic and mechanical strength by an electric contact including: a base material in which higher than 0 at % and not higher than 10 at % of Mn is solid-dissolved with respect to 100 at % of Cu; WC particles dispersed in the base material; and an intermetallic compound containing a MnTe compound, and a compound of a Mn—Cu solid-solution phase and Te. The particle diameter of the WC particles is not smaller than 0.1 μm and not larger than 10 μm. If the mass of the entirety is defined as 100 mass %, the mass of the WC particles is not lower than 20 mass % and not higher than 80 mass %, the mass of the Te atoms is not lower than 1.5 mass % and not higher than 15 mass %, and the remainder is the base material. The atomic weight ratio Mn/(Mn+Te) is not lower than 20 at % and not higher than 80 at %.

Figure 14:
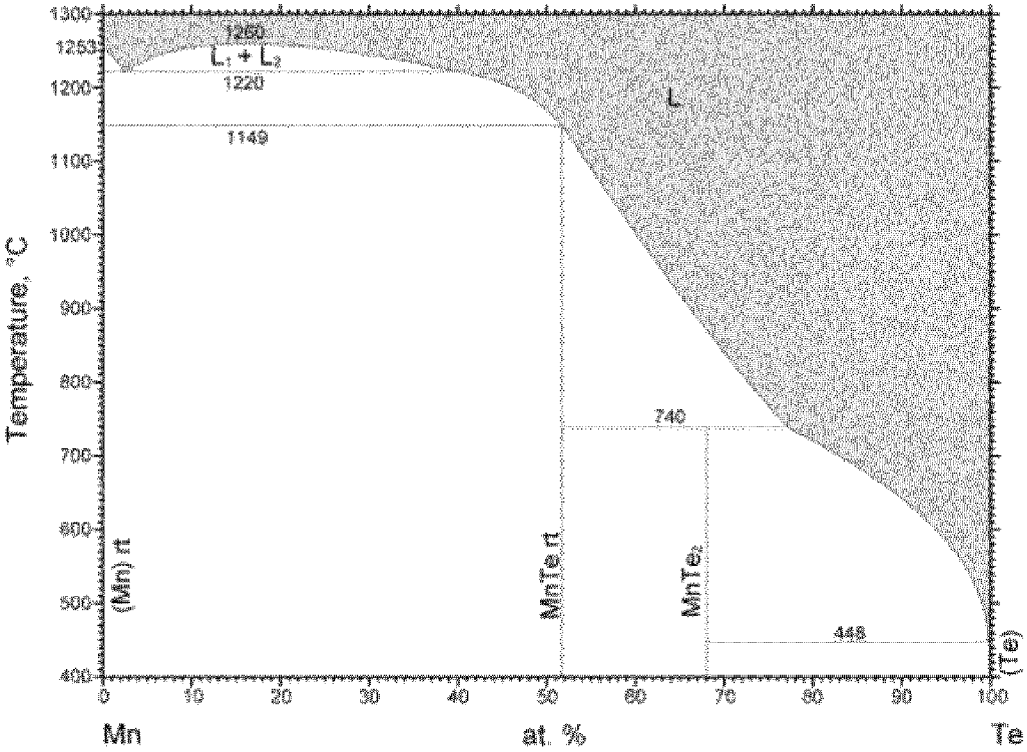
FIG. 14 is a Mn—Te phase diagram in Embodiment 1 of the present invention.
Figure 15:
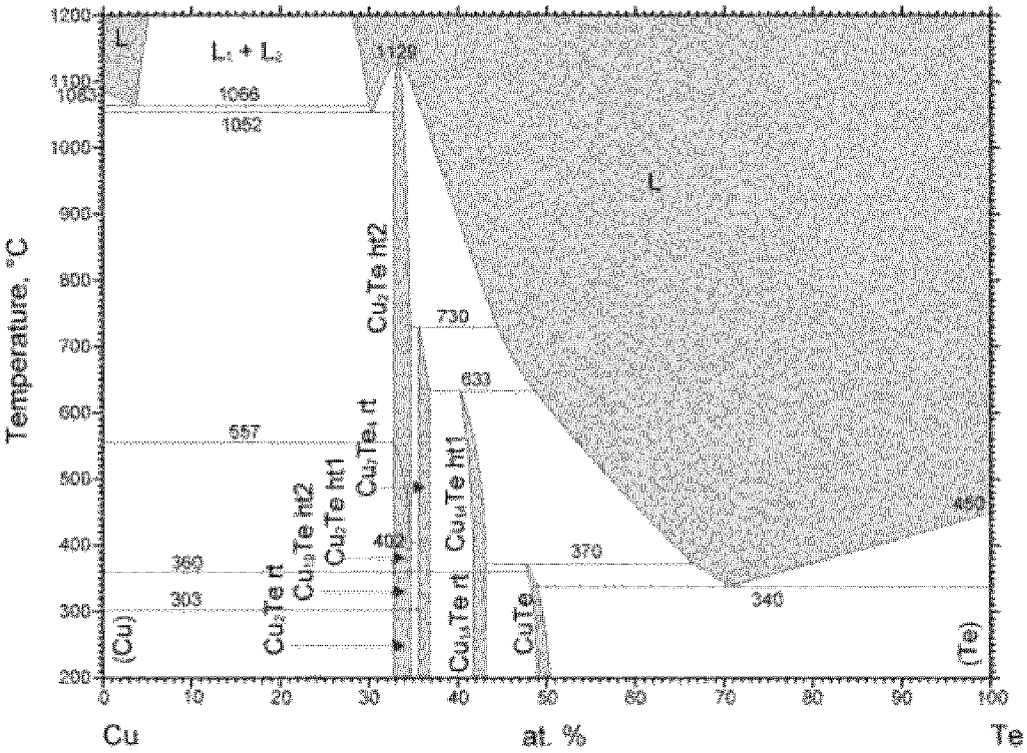
FIG. 15 is a Cu—Te phase diagram in Embodiment 1 of the present invention.

In the electric contact having the above-described composition, evaporation of Te necessary for a low chopping characteristic to be imparted occurs when the electrode is heated by an arc to a temperature not lower than the solidus of MnTe or the solidus of $Cu_2Te$. FIG. 14 is a Mn—Te phase diagram, and FIG. 15 is a Cu—Te phase diagram. As indicated in FIG. 14 and FIG. 15, the solidus of MnTe and the solidus of $Cu_2Te$ are 1149° C. and 1129° C., respectively. Te sublimes at temperatures not lower than the respective solid. Since the boiling points of the intermetallic compounds of MnTe and $Cu_2Te$ are approximately equal to each other, there is no difference in the capability of generating Te vapor from the intermetallic compound, and the low chopping characteristics are obtained as long as the Te concentration is not lower than 1.5 mass %.

If Mn is added such that Mn is solid-dissolved into Cu which is an electrically conductive component, the conductance of the electric contact can be reduced. With a moderately low conductance, the surface temperature of the electric contact can be increased at the time of interruption. As a result, sublimation of Te from MnTe and $Cu_2Te$ and thermal electron emission from the high-melting-point metal of the WC particles are promoted, whereby low chopping characteristics are obtained.

Furthermore, Mn has a higher reactivity than Te, prevents oxidation of Te in the electric contact inevitably occurring in heating treatment, and forms MnO. Since the boiling point of $TeO_2$ is higher than the boiling point of each of MnTe and $Cu_2Te$, $TeO_2$ is less likely to be generated, thereby preventing evaporation of Te. As a result, Mn added into the electrically conductive component functions as a sacrificial material for preventing oxidation of Te.

In the present embodiment, the examples and the comparative examples have been described with the WC particles being used as the high-melting-point substance particles. However, high-melting-point substance particles other than the WC particles (melting point: 3058° C.) can be used as long as the high-melting-point substance particles are a high-melting-point material having a melting point not lower than 1600° C. As the high-melting-point material having a melting point not lower than 1600° C., metals such as W (melting point: 3407° C.), Ta (melting point: 2985° C.), Cr (melting point: 1857° C.), Mo (melting point: 2623° C.), Nb (melting point: 2477° C.), Ti (melting point: 1666° C.), and V (melting point: 1917° C.), may be used. In addition, carbides thereof such as TaC (melting point: 4258° C.), $Cr_3C_2$ (melting point: 2168° C.), $Mo_2C$ (melting point: 2795° C.), NbC (melting point: 3886° C.), TiC (melting point: 3530° C.), and VC (melting point: 2921° C.), may also be used.

In the present embodiment, the examples and the comparative examples have been described with Te being used as the low-boiling-point metal. However, Se which belongs to the same group as that of Te and of which phase diagrams with Mn and Cu are similar to each other, may be used instead of Te.

Up until now, the present inventors have studied a factor in the problem that an electric contact having Te (or Se) added therein becomes brittle, which is a problem of a conventional electric contact having a low chopping characteristic. The present inventors performed analysis through observation, with an SEM, of a fractured surface of an electric contact fractured in a three-point bending test. As a result, it has been found that Te (or Se) added in the electric contact forms, together with Cu, $Cu_2Te$ (or $Cu_2Se$) of an intermetallic compound. Furthermore, a trace of delamination was observed at the intermetallic compound. This led to a finding that $Cu_2Te$ (or $Cu_2Se$) undergoes cleavage fracture and causes transgranular fracture.

It is found that, in the electric contact according to the present embodiment, formation of $Cu_2Te$ (or $Cu_2Se$) which is a factor in making the electric contact brittle is suppressed, Mn and Te form an intermetallic compound with the ratio of Mn to Te being 1:1, and the prototype of the crystal structure is a NiAs type, and thus delamination can be inhibited.

Furthermore, the mechanical strength of the electric contact can be ensured if the Mn/(Mn+Te) ratio is set to 25 to 80 at %.

The electric contact having such a structure can be inhibited from becoming brittle while having a low chopping characteristic due to selective evaporation of the low-boiling-point metal. In particular, if the concentration of Mn+Te with respect to Mn is prescribed, an electric contact having a desired strength can be produced. That is, since the welding tear-off force can be freely controlled, large-current interruption characteristics are improved.

The contact material in the present embodiment may contain a very small amount of inevitable impurities (Ag, Al, Fe, Si, and the like) contained in a raw material.

Embodiment 2

For each electric contact described in Embodiment 1, the Cu—WC—Mn—Te sintered body was infiltrated with Cu using the Cu circular plate or the Cu rectangular plates. In Embodiment 2, an electric contact produced by infiltrating a Cu—WC sintered body with Mn and Te in addition to Cu, will be described.

Example 18

First, Cu powder having an average particle diameter of 10 μm and WC powder having an average particle diameter of 6.3 μm were mixed for 30 minutes, to produce a uniform mixture powder. The mixture powder was put into a die (made of steel) having an inner diameter φ of 23 mm, and was pressurized and molded at a pressure of 400 Mpa using a hydraulic pressing machine, to produce a molded body having a thickness of 5 mm. In addition to this molded body, Cu powder having an average particle diameter of 10 μm, Mn powder having an average particle diameter of 30 μm, and Te powder having an average particle diameter of 40 μm, were mixed for 30 minutes, to produce a uniform mixture powder. The mixture powder was put into a die (made of steel) having an inner diameter φ of 20 mm, and was pressurized and molded at a pressure of 200 MPa using the hydraulic pressing machine, to produce a molded body having a thickness of 2.2 mm.

Next, the Cu—WC molded body and the Cu—Mn—Te molded body were individually sintered in a hydrogen atmosphere at 900° C. for two hours.

Next, the Cu—Mn—Te sintered body was placed on the lower side of the Cu—WC sintered body obtained by the sintering, and the Cu—WC sintered body was infiltrated in a hydrogen atmosphere at 1110° C. for two hours, to obtain an electric contact of Example 18.

In the present example, the mass ratio between the Cu powder, the WC powder, the Te powder, and the Mn powder at the time of production of the mixture powders was adjusted, thereby adjusting the composition of the electric contact. The mechanical strength, the chopping characteristic, and the interruption characteristic of the produced electric contact were evaluated in the same manner as in Embodiment 1.

FIG. 16 (Table 6) indicates the composition and the characteristics of the electric contact obtained in Example 18. With the electric contact of Example 18, characteristics similar to those of the contacts of Examples 1 to 12 in Embodiment 1 were obtained.

In Embodiment 1 described by means of Examples 1 to 12, when the Cu—WC—Mn—Te molded body was calcined, the molded body slightly swelled. This is thought to be because Cu, Te, and Mn reacted with one another in the molded body and the volume of the molded body increased.

Meanwhile, if the Cu—WC molded body and the Cu—Mn—Te molded body which is a to-be-infiltrated material are separately calcined as in the present embodiment, the volume of the Cu—WC molded body does not increase, and the electric contact can be stably produced.

Embodiment 3

In Embodiment 1, the Cu—WC—Mn—Te sintered body was infiltrated with Cu, to produce the electric contact. In Embodiment 2, the Cu—WC sintered body was infiltrated with Cu—Mn—Te, to produce the electric contact. Meanwhile, in Embodiment 3, an electric contact produced without performing infiltration but produced only by sintering, will be described.

Example 19

First, Cu powder having an average particle diameter of 10 μm, WC powder having an average particle diameter of 6.3 μm, Mn powder having an average particle diameter of 30 μm, and Te powder having an average particle diameter of 40 μm, were mixed for 30 minutes, to produce a uniform mixture powder. The mixture powder was put into a die (made of steel) having an inner diameter φ of 23 mm, and was pressurized and molded at a pressure of 650 Mpa using a hydraulic pressing machine, to produce a Cu—WC—Mn—Te molded body having a thickness of 5 mm.

Next, the Cu—WC—Mn—Te molded body was sintered in a hydrogen atmosphere at 1110° C. for two hours.

Next, the Cu—WC—Mn—Te sintered body obtained by the sintering was pressurized again at a pressure of 650 Mpa using the hydraulic pressing machine, and was sintered again in a hydrogen atmosphere at 1110° C. for two hours, to obtain an electric contact of Example 19.

In the present example, the mass ratio between the Cu powder, the WC powder, the Te powder, and the Mn powder at the time of production of the mixture powder was adjusted, thereby adjusting the composition of the electric contact. The mechanical strength, the chopping characteristic, and the interruption characteristic of the produced electric contact were evaluated in the same manner as in Embodiment 1.

FIG. 17 (Table 7) indicates the composition and the characteristics of the electric contact obtained in Example 19. With the electric contact of Example 19, characteristics similar to those of the contacts of Examples 1 to 12 in Embodiment 1 were obtained. The relative density of the electric contact obtained in Example 19 was 95.3%. Here, the relative density was obtained by an expression "relative density (%)=(measured density of electric contact material/theoretical density of electric contact material obtained from composition analysis value)×100". If the relative density is not higher than 95%, the relative density can be set to be not lower than 95% by repeating re-pressurization and re-sintering.

In the method for producing the electric contact through infiltration described in each of Embodiment 1 and Embodiment 2, the liquefied Cu or Cu—Mn—Te was poured into the molded body at the time of the infiltration, and thus variation in the composition easily occurs at the time of production owing to variation in the porosity of the molded body.

Meanwhile, the electric contact produced only by sintering as in the present embodiment has undergone only a step of sintering the molded body, and thus variation in the composition due to difference in the porosity at the time of molding is small.

Embodiment 4

Although the WC particles were used as the high-melting-point substance particles in Embodiment 1, WC particles were used as the high-melting-point substance particles in Embodiment 4.

In the present embodiment, electric contacts in each of which W particles having a lower Vickers hardness than WC were used instead of the WC particles used in Embodiment 1, will be described. Each electric contact in the present embodiment is the same as that in Embodiment 1, except that the W particles were used instead of the WC particles. The method for producing the electric contact and the method for evaluating the chopping characteristic and the interruption characteristic of the electric contact, are also the same as those in Embodiment 1.

Figures 19, 20:
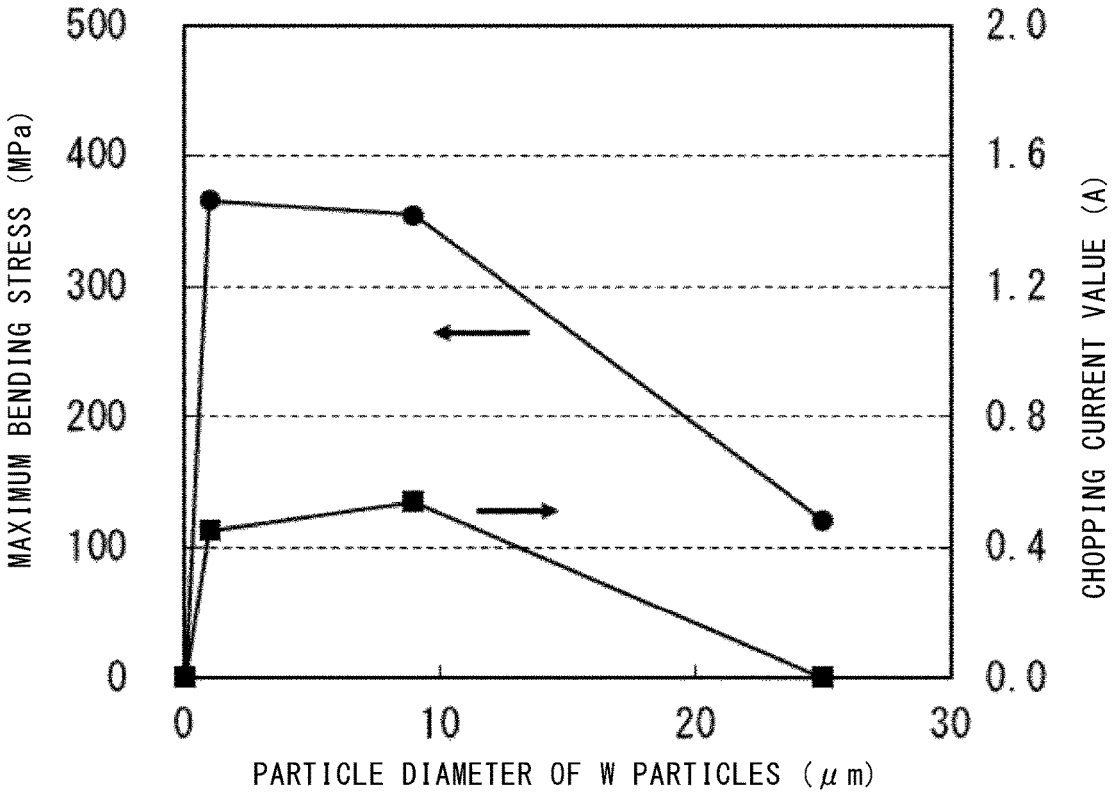
FIG. 19 is a characteristic graph of the electric contacts according to Embodiment 4 of the present invention.
FIG. 20 is a characteristic table indicating the Vickers hardnesses of high-melting-point substance particles in Embodiment 5 of the present invention.

FIG. 18 (Table 8) is a table indicating the compositions and the characteristics in examples and comparative examples in the present embodiment. FIG. 19 is a characteristic graph indicating the compositions and the characteristics in the examples and the comparative examples indicated in FIG. 18 (Table 8). In FIG. 18 (Table 8), the composition ratio (mass %) of the W particles, the composition ratio of Mn, and the Mn/(Mn+Te) ratio are fixed. Thus, in FIG. 19, the particle diameter (μm) of the W particles is used as the horizontal axis, and maximum bending stress and chopping current value are used as the vertical axes.

W has a Vickers hardness of 360 Hv and is the hardest material among pure metals. In the present embodiment, in the case where the particle diameter was 25 μm (Comparative Example 11), a crack was generated at the time of machining in the same manner as in the equivalent electric contact of Embodiment 1 in which the WC particles were used. In the electric contact in which the particle diameter of the W particles was set to 0.08 μm (Comparative Example 12), a crack was generated at the time of production of the molded body. As in the case of the WC particles in Embodiment 1, if the powder that is hard and not plastically deformable becomes fine, the specific surface area of the powder increases. Thus, when powders are pressurized and molded, a large number of voids are present near the contact points between the powders, and it becomes difficult to achieve densification. Therefore, the molding pressure needs to be high in order to obtain a desired molded body. It is considered that, since more molding pressure than necessary was applied, deformation occurred and the crack was generated in the molded body.

The Vickers hardness of WC used in Embodiment 1 is 690 Hv, and the Vickers hardness of W used in the present embodiment is 360 Hv. According to results in Embodiment 1 and the present embodiment, if the Vickers hardness of high-melting-point substance particles is not lower than 200 Hv, the particle diameter of the high-melting-point substance particles needs to be not smaller than 0.1 μm and not larger than 10 μm.

Embodiment 5

The WC particles having a Vickers hardness of 690 Hv were used as the high-melting-point substance particles in Embodiment 1, and the W particles having a Vickers hardness of 360 Hv were used as the high-melting-point substance particles in Embodiment 4. In these cases, the particle diameters of the WC particles and the W particles were set to be not smaller than 0.1 μm and not larger than 10 μm. In Embodiment 5, a case where a material having a relatively low hardness was used as the high-melting-point substance particles, will be described.

First, the hardness of the high-melting-point substance particles will be described. The high-melting-point substance particles are a material that is relatively harder than electrically conductive metals such as Cu and Ag, among metals. Thus, when the hard material is ground at the time of machining, a load is applied to the electric contact. As described in Embodiment 1, an electric contact in which an electrically conductive component not having Mn added therein or high-melting-point substance particles having a large particle diameter are used, has low base material strength. Thus, such an electric contact cannot endure a load applied at the time of machining, resulting in generation of a crack.

From the above-described viewpoint, the load applied when an electric contact material is machined can be said to be related to the hardness of the high-melting-point substance particles contained in the electric contact material. FIG. 20 (Table 9) is a characteristic table indicating Vickers hardnesses of metals and carbides thereof which are used as the high-melting-point substance particles. In FIG. 20 (Table 9), Vickers hardness is used. However, Rockwell hardness or Brinell hardness may be used if a conversion table is used. It is noted that the values of the Vickers hardnesses of carbides vary according to a producing method, a composition, or a hardness measurement method. Thus, it was determined that the values indicated in FIG. 20 (Table 10) were merely examples and that small variations in the values would pose no problem in the following examples. It can be said that, regarding the metals indicated in FIG. 20 (Table 9), all the carbides have higher hardnesses than the pure metals.

In the present embodiment, electric contacts in each of which Mo particles or Cr particles having lower Vickers hardnesses than WC were used instead of the WC particles used in Embodiment 1, will be described. Each electric contact in the present embodiment is the same as that in Embodiment 1, except that Mo particles or Cr particles were used instead of the WC particles. The method for producing the electric contact and the method for evaluating the chopping characteristic and the interruption characteristic of the electric contact, are also the same as those in Embodiment 1.

FIG. 21 (Table 10) is a table indicating the compositions and the characteristics in examples and comparative examples in which the Mo particles were used, in the present embodiment. FIG. 22 (Table 11) is a table indicating the compositions and the characteristics in examples and comparative examples in which the Cr particles were used, in the present embodiment.

Figure 23:
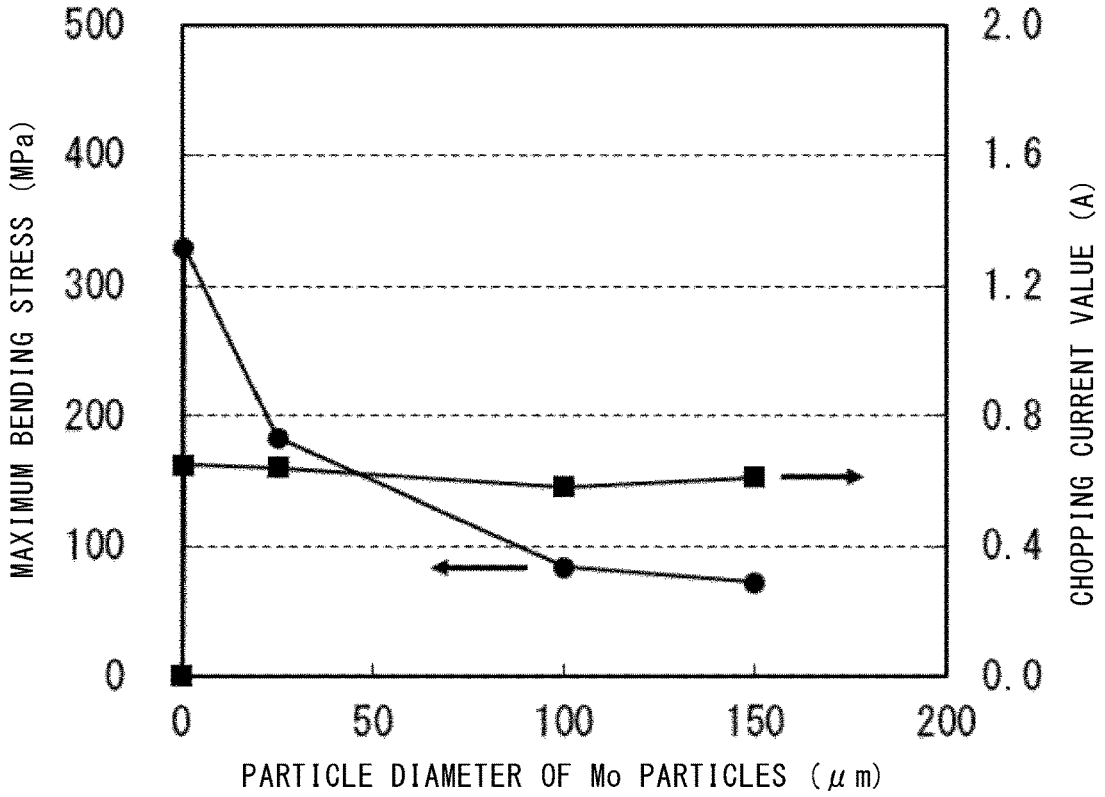
FIG. 23 is a characteristic graph of the electric contacts according to Embodiment 5 of the present invention.
Figure 24:
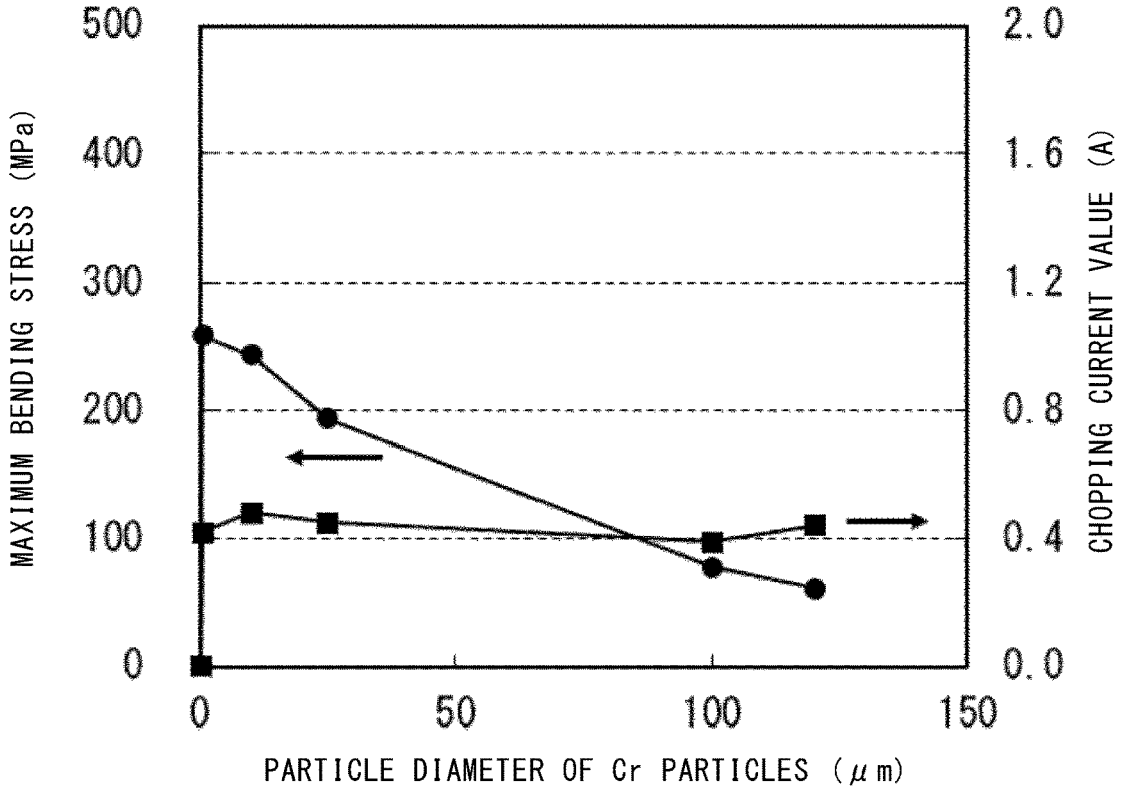
FIG. 24 is a characteristic graph of the electric contacts according to Embodiment 5 of the present invention.

FIG. 23 is a characteristic graph indicating the compositions and the characteristics in the examples and the comparative examples indicated in FIG. 21 (Table 10). FIG. 24 is a characteristic graph indicating the compositions and the characteristics in the examples and the comparative examples indicated in FIG. 22 (Table 11). In each of FIG. 21 (Table 10) and FIG. 22 (Table 11), the composition ratio (mass %) of the Mo particles or the Cr particles, the composition ratio of Mn, and the Mn/(Mn+Te) ratio are fixed. Thus, in each of FIG. 23 and FIG. 24, the particle diameter (μm) of the Mo particles or the Cr particles is used as the horizontal axis, and maximum bending stress and chopping current value are used as the vertical axes.

According to FIG. 23 and FIG. 24, in the case where Mo having a Vickers hardness of 160 Hv or Cr having a Vickers hardness of 120 Hv was used as the high-melting-point substance particles, no crack was generated at the time of machining even if the particle diameter was 25 μm, and the interruption test was also passed even if the particle diameter was 100 μm. In the case where the Vickers hardness was not higher than 200 Hv, no problem arose in chopping performance and interruption performance if the particle diameter of the high-melting-point substance particles was in a range of not smaller than 0.1 μm and not larger than 100 μm. In addition, no crack was generated at the time of processing, and no breakage occurred at the time of production of the molded body.

In the case where a material having a Vickers hardness not higher than 200 Hv was used as the high-melting-point substance particles, if the particle diameter thereof was 100 μm, the mechanical strength obtained in a three-point bending test was less than 100 MPa, but no crack was generated at the time of machining. It can be said that, at the time of machining, a crack is generated depending on the hardness of the high-melting-point substance particles. At the time of machining, when a harder material is ground, a greater load is applied to the electric contact which is a to-be-ground product. Thus, since WC described in Embodiment 1 is harder than the pure metals, the lower limit for the strength at which the electric contact was able to be machined without generating any crack therein, was 200 MPa. Meanwhile, it is considered that, since a load applied at the time of machining in the case of Mo or Cr softer than WC was less than in the case of WC, the machining was successfully performed without generating any crack even if the strength was not greater than 100 MPa. As described above, in the case where the high-melting-point substance particles softer than WC and W were used, the mechanical strength of the electric contact decreased. However, no crack was generated even if the particle diameter was 25 μm, and no practical problem arose if the particle diameter was not larger than 100 μm.

In Embodiment 1, as the particle diameter of WC increased, a crack was generated at the time of machining, and in addition, failure of interruption was observed. However, in the case of Mo and Cr, even if the particle diameter thereof was not smaller than 10 μm, no failure of interruption was observed. It is inferred that, in the case of WC, the surface became more uneven as the particle diameter increased, and thus arcs were concentrated, whereby interruption failed. Meanwhile, it is inferred that, since Mo and Cr are materials softer than WC, the high-melting-point substance particles themselves were ground at the time of machining, and the surface did not become overly uneven, whereby interruption was stably performed.

In the present embodiment, if the particle diameter of the high-melting-point substance particles was larger than 100 μm, the interruption test was failed. This is thought to be because, even though the high-melting-point substance particles themselves were ground and the surface was less uneven, the particle diameter of the high-melting-points substance particles having been ground was large, and thus arcs were accumulated on a portion of the high-melting-point substance particles. Since Mo and Cr are soft particles, the particles are plastically deformed easily even if the particle diameters thereof are small. Thus, the particles were successfully molded even if the particle diameters thereof were 0.5 μm.

According to the above description, in the case where the Vickers hardness of the high-melting-point substance particles is not higher than 200 Hv, no problem arises even if the particle diameter thereof is not smaller than 0.1 μm and 100 μm.

DESCRIPTION OF THE REFERENCE CHARACTERS

1 vacuum interrupter
2 interruption chamber
3 insulation container
4*a*, 4*b* sealing metal member
5*a*, 5*b* metal lid
6 fixed electrode rod
7 movable electrode rod
8 fixed electrode
9 movable electrode
10 fixed electric contact
11 movable electric contact
12 bellows
13 bellows arc shield
14 insulation container arc shield
20 electric contact
21 test piece
31 base material
32 WC particle
33 Mn—Cu—Te intermetallic compound

The invention claimed is:

1. An electric contact comprising:

a base material in which higher than 0 at % and not higher than 10 at % of Mn is solid-dissolved with respect to 100 at % of Cu;

high-melting-point substance particles which are dispersed in the base material and which particles of a metal or particles of a carbide of the metal; and an intermetallic compound containing X atoms and dispersed in the base material, wherein X is Te or Se, wherein the metal is at least one metal selected from among W, Ta, Cr, Mo, Nb, Ti, and V, wherein a Vickers hardness of the high-melting-point substance particles is not lower than 0 HV and not higher than 200 HV, and a particle diameter of the high-melting-point substance particles is not smaller than 0.1 μm and not larger than 100 μm, or wherein the Vickers hardness of the high-melting-point substance particles is not lower than 200 HV, and the particle diameter is not smaller than 0.1 μm and not larger than 10 μm, and wherein a mass of the high-melting-point substance particles is not lower than 20 mass % and not higher than 80 mass %, a total mass of the electrical contact being defined as 100 mass %, wherein a mass of the X atoms is not lower than 1.5 mass % and not higher than 15 mass %, and a remainder is the base material, wherein the intermetallic compound contains a MnX compound, and a compound of a Mn—Cu solid-phase solution and X, and wherein an atomic weight ratio Mn/(Mn+X) is not lower than 20 at % and not higher than 80 at %.

2. The electric contact according to claim 1, wherein the compound of the Mn—Cu solid-phase solution and X has a composition that is at least either of (Mn,Cu)X and $(Mn,Cu)_2X$.

3. The electric contact according to claim 2, wherein the base material further contains 5 at % of MnO.

4. A vacuum interrupter comprising:

a fixed electrode;

a movable electrode which comes into contact with and becomes apart from the fixed electrode; and an interruption chamber which holds, in vacuum, the fixed electrode and the movable electrode, wherein the electric contact according to claim 2 is used as at least either of a fixed electric contact and a movable electric contact which are provided to contact portions of the fixed electrode and the movable electrode, respectively.

5. The electric contact according to claim 1, wherein the base material further contains 5 at % of MnO.

6. A vacuum interrupter comprising:

a fixed electrode;

a movable electrode which comes into contact with and becomes apart from the fixed electrode; and an interruption chamber which holds, in vacuum, the fixed electrode and the movable electrode, wherein the electric contact according to claim 5 is used as at least either of a fixed electric contact and a movable electric contact which are provided to contact portions of the fixed electrode and the movable electrode, respectively.

7. A vacuum interrupter comprising:

a fixed electrode;

a movable electrode which comes into contact with and becomes apart from the fixed electrode; and an interruption chamber which holds, in vacuum, the fixed electrode and the movable electrode, wherein the electric contact according to claim 1 is used as at least either of a fixed electric contact and a movable electric contact which are provided to contact portions of the fixed electrode and the movable electrode, respectively.

* * * * *